US008800821B2

(12) United States Patent
Maguire et al.

(10) Patent No.: US 8,800,821 B2
(45) Date of Patent: Aug. 12, 2014

(54) DISPOSABLE LOW-COST PUMP IN A CONTAINER FOR LIQUID COLOR DISPENSING

(75) Inventors: Paul Sherwood Maguire, Thornton, PA (US); Steven B. Maguire, Glenn Mills, PA (US)

(73) Assignee: Maguire Products, Inc., Aston, PA (US)

( * ) Notice: Subject to any disclaimer, the term of this patent is extended or adjusted under 35 U.S.C. 154(b) by 709 days.

(21) Appl. No.: 12/706,292

(22) Filed: Feb. 16, 2010

(65) Prior Publication Data

US 2011/0200464 A1 Aug. 18, 2011

(51) Int. Cl.

| | |
|---|---|
| ***B65D 88/54*** | (2006.01) |
| ***B05B 11/00*** | (2006.01) |
| ***F04B 15/00*** | (2006.01) |
| ***F04B 13/00*** | (2006.01) |
| ***F04B 9/127*** | (2006.01) |
| ***F04B 53/10*** | (2006.01) |
| ***F04B 9/12*** | (2006.01) |

(52) U.S. Cl.

CPC ..... *F04B 13/00* (2013.01); *F04B 15/00* (2013.01); *F04B 9/127* (2013.01); *F04B 53/1062* (2013.01); *F04B 9/1215* (2013.01)

USPC ..... 222/334; 222/385; 222/341; 222/382; 417/392; 417/568

(58) Field of Classification Search

USPC ..... 222/334, 385, 341, 383.1, 382; 417/403, 568, 392

See application file for complete search history.

(56) References Cited

U.S. PATENT DOCUMENTS

| | | | |
|---|---|---|---|
| 600,233 | A | 3/1898 | Palm |
| 1,451,759 | A | 4/1923 | Bruhn |
| 1,489,348 | A | 4/1924 | Hampton |

(Continued)

FOREIGN PATENT DOCUMENTS

| | | | |
|---|---|---|---|
| DE | 3433693 | A1 | 3/1986 |
| FR | 1 477 595 | A | 4/1967 |
| GB | 1145752 | | 3/1969 |
| WO | WO 01/49374 | A1 | 7/2001 |

OTHER PUBLICATIONS

Forty-four page two-sided brochure including cover and back pages entitled "Maguire: Auxiliary equipment for the plastics industry" of Maguire Products, Inc., Oct. 2000.

(Continued)

*Primary Examiner* — Kevin P Shaver
*Assistant Examiner* — Nicholas J Weiss
(74) *Attorney, Agent, or Firm* — Charles N. Quinn; Fox Rothschild LLP

(57) ABSTRACT

A pump has a PVC "T" shaped member having an inlet, an outlet and an interior pumping chamber positioned between the inlet and outlet; a piston displaceable into the chamber; an air cylinder for driving the piston into the chamber; a spring for biasing the piston outwardly from the chamber in opposition to force applied by the air cylinder; a washer-urethane disk check valve at the conduit inlet permitting fluid flow into the chamber but precluding fluid flow out of the chamber responsively to piston displacement into the chamber; and a washer-urethane disk check valve at the conduit outlet permitting fluid flow out of the chamber responsively to fluid pressure increase resulting from piston displacement into the chamber.

33 Claims, 3 Drawing Sheets

(56) References Cited

U.S. PATENT DOCUMENTS

| | | | | | |
|---|---|---|---|---|---|
| 2,188,646 | A | | 1/1940 | Bunch | |
| 2,199,657 | A | | 5/1940 | Bunch | |
| 2,387,233 | A | * | 10/1945 | Clapp | 222/334 |
| 2,606,696 | A | | 8/1952 | Miner | |
| 2,656,828 | A | | 10/1953 | Conover | |
| 2,665,825 | A | | 1/1954 | Poitras et al. | |
| 2,701,881 | A | | 2/1955 | McGee | |
| 2,873,892 | A | * | 2/1959 | Nelson et al. | 222/309 |
| 2,909,315 | A | | 10/1959 | Sampietro | |
| 3,391,645 | A | * | 7/1968 | Koza | 417/565 |
| 3,518,033 | A | | 6/1970 | Anderson | |
| 3,785,412 | A | | 1/1974 | Stone | |
| 3,814,388 | A | | 6/1974 | Jakob | |
| 3,883,275 | A | * | 5/1975 | Browne | 417/503 |
| 3,957,399 | A | | 5/1976 | Siczek | |
| 3,988,088 | A | | 10/1976 | King et al. | |
| 3,998,103 | A | | 12/1976 | Bjorklund et al. | |
| 4,185,948 | A | | 1/1980 | Maguire | |
| 4,473,173 | A | | 9/1984 | DeGroff et al. | |
| 4,501,405 | A | | 2/1985 | Usry | |
| 4,571,416 | A | | 2/1986 | Jarzombek et al. | |
| 4,586,882 | A | | 5/1986 | Tseng | |
| 4,605,297 | A | | 8/1986 | Livingston et al. | |
| 4,606,710 | A | | 8/1986 | Maguire | |
| 4,621,990 | A | | 11/1986 | Forsythe et al. | |
| 4,657,490 | A | | 4/1987 | Abbott | |
| 4,967,940 | A | | 11/1990 | Blette et al. | |
| 5,039,279 | A | | 8/1991 | Natwick et al. | |
| 5,199,852 | A | | 4/1993 | Danby | |
| 5,215,215 | A | | 6/1993 | Sauer | |
| 5,225,210 | A | | 7/1993 | Shimoda | |
| 5,344,232 | A | | 9/1994 | Nelson et al. | |
| 5,364,242 | A | | 11/1994 | Olsen | |
| 5,853,244 | A | | 12/1998 | Hoff et al. | |
| 5,953,923 | A | | 9/1999 | Davies | |
| 5,980,490 | A | | 11/1999 | Tsoukalis | |
| 5,988,983 | A | | 11/1999 | Furusawa | |
| 6,007,236 | A | | 12/1999 | Maguire | |
| 6,057,514 | A | | 5/2000 | Maguire | |
| 6,188,936 | B1 | | 2/2001 | Maguire et al. | |
| 6,213,739 | B1 | | 4/2001 | Phallen et al. | |
| 6,386,841 | B1 | | 5/2002 | Probst | |
| 6,402,363 | B1 | | 6/2002 | Maguire | |
| 6,502,013 | B1 | | 12/2002 | Sosnik | |
| 6,599,005 | B2 | | 7/2003 | van Der Wei | |
| 6,719,453 | B2 | | 4/2004 | Cosman et al. | |
| 6,880,965 | B1 | | 4/2005 | Sheffield, Jr. | |
| 6,991,004 | B2 | | 1/2006 | Kaufhold et al. | |
| 7,118,349 | B2 | * | 10/2006 | Oglesby | 417/53 |
| 7,154,069 | B1 | | 12/2006 | Gordon | |
| 795,891 | A1 | | 6/2011 | Maguire | |
| 2002/0023449 | A1 | | 2/2002 | Park et al. | |
| 2002/0031822 | A1 | | 3/2002 | Van der Wei et al. | |
| 2003/0142580 | A1 | | 7/2003 | Maguire | |
| 2003/0218014 | A1 | | 11/2003 | Gregory et al. | |
| 2005/0052945 | A1 | | 3/2005 | Maguire | |
| 2006/0067844 | A1 | | 3/2006 | Iversen | |
| 2007/0071624 | A1 | * | 3/2007 | Brewer | 417/568 |
| 2012/0260992 | A1 | | 10/2012 | Maguire | |

OTHER PUBLICATIONS

Two-sided color brochure entitled Maguire: Model MPA Liquid Color Pump , Maguire Products, Inc., published Dec. 28, 1995.

International Search Report for PCT/US02/02934, dated Feb. 20, 2003.

Written Opinion for PCT/US02/02934, dated Mar. 24, 2003.

Thirty-two page catalog entitled "Maguire Color Blending Equipment" published by Maguire Products, Inc., 1993, United States.

International Search Report for PCT/US11/021994, dated May 24, 2011.

Written Opinion for PCT/US11/021994, dated May 24, 2011.

* cited by examiner

DISPOSABLE LOW-COST PUMP IN A CONTAINER FOR LIQUID COLOR DISPENSING

BACKGROUND OF THE INVENTION

1. Field of the Invention

This invention relates to storage, handling and dispensing of liquid color for use in plastic fabricating, specifically in injection and compression molding, and in extrusion.

2. Description of the Prior Art and Commercial Practice

The "pump in a drum" concept is that every drum filled with liquid color has a pump included within it. This relieves the liquid color customer from having to own and from maintaining the pump, and from moving the pump from drum to drum. Liquid color can be very messy and difficult to handle, like oil-based paint, so it is desirable to eliminate or minimize the handling of liquid color-contaminated parts, pumps, tubing, etc.

Because pumps are costly, the empty liquid color drum, with the pump inside, must be returned for refill. The cost of pumps currently used is around $100.00, which is too high to throw away the pump with the drum.

Returning the drum presents its own set of problems, namely shipping costs, storage costs, tracking, risk of the drum being contaminated before being refilled, costs to clean or dispose of contaminated drums, etc.

SUMMARY OF THE INVENTION

This invention provides a solution to the problems associated with liquid color supply equipment by making the pump sufficiently inexpensive, with a cost in the neighborhood of from $5.00 to $10.00, so that it can be discarded. The only way to produce such a pump, in a market where demand for such pump and drum combinations is limited, is to construct the pump from parts that are produced for another market that uses very large quantities of such parts, thereby driving the down costs of such parts to a very low level.

PVC pipe and pipe fittings are examples of such parts, which are produced in very high volumes and therefore are available at low, commodity prices.

In one of its aspects, this invention provides a pump with a conduit having an inlet, an outlet and a chamber positioned between the inlet and the outlet with a piston being displaceable into the chamber. The pump further includes an air cylinder for driving the piston into the chamber, and a spring for biasing the piston outwardly from the chamber. An inlet check valve is at the conduit inlet for permitting fluid flow into the chamber but precluding fluid flow out of the chamber responsively to piston displacement into the chamber. The pump further includes an outlet check valve at the conduit outlet, for permitting fluid flow out of the chamber responsively to fluid pressure increase resulting from piston displacement into the chamber.

In yet another of its aspects, this invention provides a pump having a "T"-shaped pipe fitting with an open interior of the fitting defining a chamber, with the leg of the "T" defining an outlet from the chamber, and one arm of the top of the "T" defining an inlet to the chamber. The pump further includes an extension conduit extending away from the remaining arm of the top of the "T", away from the chamber, and a piston displaceable along and through at least a portion of the extension conduit towards the chamber. The pump yet further includes an air cylinder for driving the piston towards the remaining arm of the top of the "T", into the chamber. The pump further includes a spring for biasing the piston outwardly from the chamber, in the absence of force applied to the piston by the air cylinder, and inlet and outlet check valves. The inlet check valve is in an inlet conduit connected to the inlet to the chamber and serves to permit fluid flow into the chamber, but precludes fluid flow out of the chamber responsively to piston displacement into the chamber.

The inlet check valve includes a first polymeric disk fitting within the inlet conduit. The disk has a preferably concentrically centered preferably circular portion partially separated from an outer ring portion of the disk, such that the center circular portion acts as a flap relative to the outer ring portion. The inlet check valve further includes a first washer facingly contacting the first disk and located upstream of the first disk relative to the chamber, with the first washer having an open center of size smaller than the centered circular portion of the first disk. Upon attempted fluid flow out of the chamber through the inlet conduit, the centered circular portion of the first disk contacts the first washer and blocks the open center thereof, thereby precluding further fluid flow out of the chamber through the inlet conduit.

The outlet check valve is located at the outlet from the leg of the "T" and permits fluid flow out of the chamber responsively to fluid pressure increase resulting from piston displacement into the chamber. The outlet check valve includes a second polymeric disk fitting within the leg of the "T" and having a concentrically centered circular portion partially separated from an outer ring portion of the second disk. The centered circular portion acts as a flap relative to the outer ring portion. The outlet check valve further includes a second washer facingly contacting the second disk and located upstream of the second disk, within the leg of the "T" relative to the chamber. The second washer has an open center of smaller size than the centered circular portion of the disk. As a result, any fluid flow into the chamber through the leg of the "T" is blocked by the centered circular portion of the disk contacting the washer and blocking the open center of the washer. This precludes further fluid flow into the chamber through leg of the "T"; fluid flowing out of the chamber through the leg of the "T" flows through the open center of the second washer and displaces the centered circular portion of the second polymeric disk in the fashion of a hinged flap, thereby permitting fluid flow to continue through the centered circular portion of the second polymeric disk.

In yet another one of its aspects, this invention provide apparatus for shipping, storing and dispensing liquid color where the apparatus includes a disposable container for receiving and storing liquid color and a pump, part of which is preferably positioned within the container, for dispensing liquid color from the container. The pump includes a one-piece "T"-shaped PVC pipefitting with an open interior of the fitting defining a chamber, the leg of the "T" defining an outlet from the chamber, and one arm of the top of the "T" defining an inlet to the chamber. A piston is displaceable through the remaining side of the top of the "T" into the chamber. An air cylinder is provided for driving a piston, located within the remaining arm of the top of the "T", towards the chamber. The pump further includes a spring for biasing the piston outwardly from the chamber, in opposition to force supplied by the air cylinder. An inlet check valve is located upstream of the inlet to the chamber, and serves to permit fluid flow into the chamber but precludes fluid flow out of the chamber responsively to piston displacement towards the chamber. The pump further includes an outlet check valve at the outlet from the leg of the "T". The outlet check valve permits fluid flow out of the chamber responsively to fluid pressure increase resulting from piston displacement into the chamber. The spring, the piston, the conduit and the check valves are preferably all within the container. The conduit outlet is connected to a fitting mounted in the container wall for discharge of liquid color from the container upon operation of the pump. The air cylinder is outside of the container and is preferably removably connected thereto via a fitting that facilitates delivery of compressed air from the air cylinder to the piston.

Desirably, the pump further includes a pair of magnetic pickups, located at the two extremities of piston travel and mounted on a conduit defining at least a part of the remaining arm of the top of the "T". These magnetic pickups sense when the piston is at the respective extremities of its travel and provide signals for respectively actuating and de-actuating the air cylinder, resulting in generally reciprocating motion of the piston in response to the air cylinder and the spring respectively.

In the apparatus, each of the check valves preferably includes a polymeric disk having a center portion that is partially separated from and movable with respect to an outer portion of the disk such that the center portion acts as a flap relative to the outer portion. Each check valve preferably further includes a washer contacting the disk, located upstream of the disk relative to a desired direction of fluid flow. The washer has a central opening smaller than but aligned with the disk center portion whereby upon fluid flow in a first direction, the center portion of the disk contacts the washer and blocks the open center thereof. This precludes further fluid flow in the first direction, but fluid flowing in the desired second direction flows through the open center of the washer and displaces the center portion of the disk for continued fluid flow through the center portion of the disk in the desired second direction. The polymeric disk is preferably urethane.

In still another one of its aspects, this invention provides a pump having a "T"-shaped pipe fitting with an open interior of the fitting defining a chamber, with one arm at the top of the "T" defining an outlet from the chamber and with the remaining arm at the top of the "T" defining an inlet to the chamber. The pump further includes a piston that is displaceable through the leg of the "T" into the chamber. The pump further includes an air cylinder for driving the piston towards the chamber. The pump yet further includes a spring for biasing the piston outwardly from the chamber, in opposition to force applied by the air cylinder. An inlet check valve is further a part of the pump and is located upstream of the inlet to the chamber and serves to permit fluid flow into the chamber but precludes fluid flow out of the chamber responsively to piston displacement towards the chamber. The pump further includes an outlet check valve located at the outlet and permits fluid flow out of the chamber responsively to fluid pressure increase resulting from piston displacement towards the chamber.

The pump desirably further includes a pair of magnetic pickups, located at the two extremities of piston travel. The magnetic pickups serve to sense when the piston is at the respective extremities of its travel and provide signals for respectively actuating and de-actuating the air cylinder, resulting in reciprocating motion of the piston in response to the air cylinder and the spring respectively.

The check valve disks are desirably urethane. The "T" shaped pipefitting is desirably PVC.

In still another one of its aspects, this invention provides apparatus for shipping, storing and dispensing liquid color where the apparatus includes a disposable container for receiving, shipping and storing liquid color. The apparatus further includes a pump for dispensing liquid color from the container, where the pump includes a PVC conduit having an inlet, an outlet and a chamber positioned between the inlet and the outlet, a piston that is displaceable into the chamber, an air cylinder for driving the piston into the chamber, a coil spring for biasing the piston coaxially outwardly from the chamber in opposition to force applied to the piston by the air cylinder, an inlet check valve at the conduit inlet is provided for permitting liquid color flow from within the container into the chamber, but precluding liquid color flow out of the chamber responsively to piston displacement into the chamber and an outlet check valve at the conduit outlet for permitting liquid color fluid flow out of the chamber responsively to fluid pressure increase resulting from piston displacement into the chamber.

In this aspect of the invention, the apparatus has the spring, the piston, the conduit and the check valves located within the container. The conduit outlet is connected to a fitting mounted in the container wall for discharge of liquid color. The air cylinder is preferably located outside of the container and is removably connected to the container via a fitting which facilitates delivery of compressed air from the air cylinder to the piston.

Figure 1:
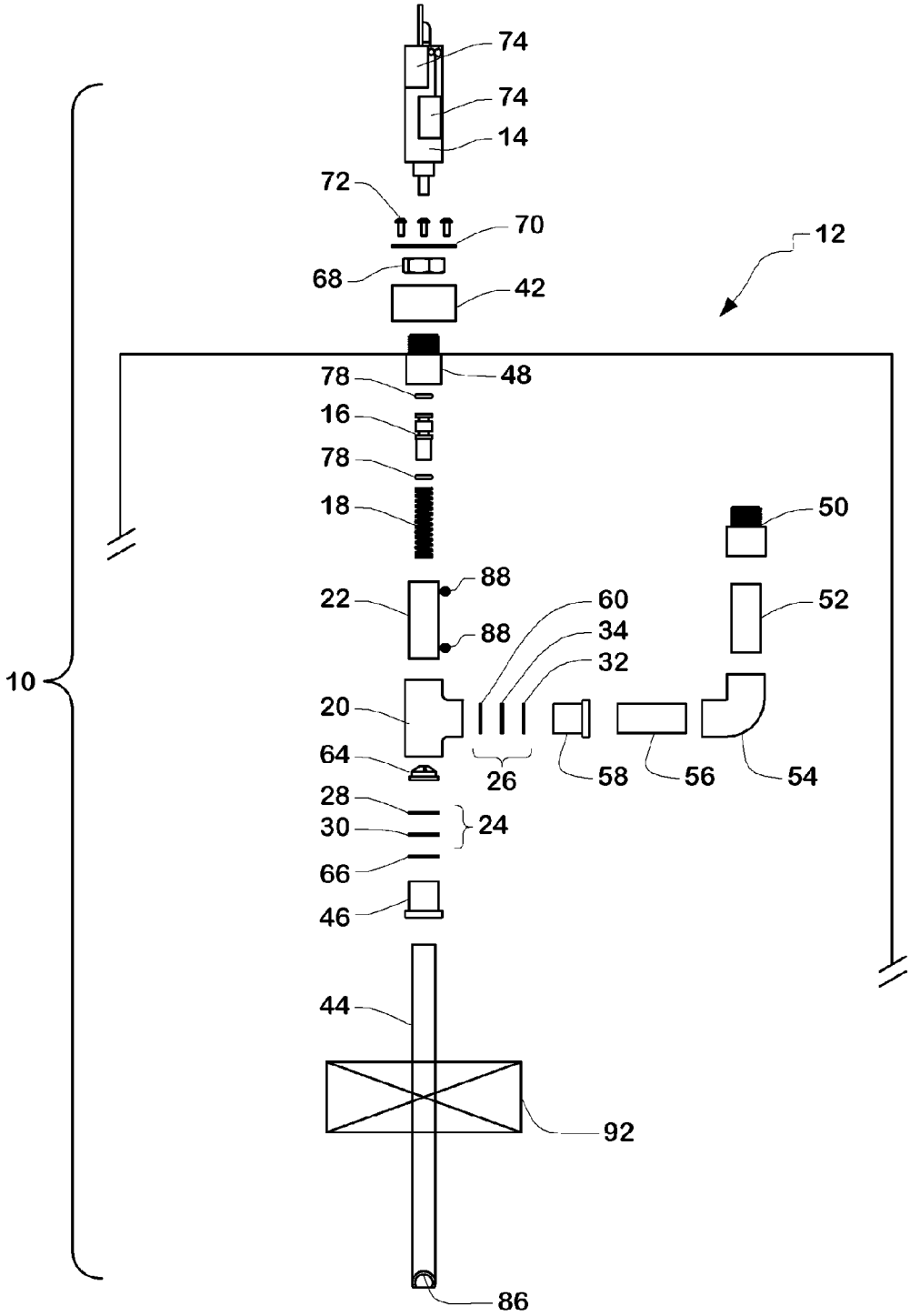
FIG. 1 is an exploded view, in elevation, of a liquid color pump and a liquid color container showing the preferred embodiment of the pump of the invention.

DESCRIPTION OF THE PREFERRED EMBODIMENTS AND BEST MODE KNOWN FOR PRACTICE OF THE INVENTION

In this invention the preferred embodiment of the pump is constructed from an assortment of PVC pipe fittings, generally and preferably two PVC elbows, two reducing bushings, a PVC "T", two straight PVC adaptors, and some PVC pipe. Most of these parts are available for less then thirty cents each.

In addition, in the preferred embodiment of the pump there is preferably a piston, two check valves, three washers, a spring, and three O-rings.

When the pump "body", namely the assembled PVC parts, and especially the PVC "T", is preferably inside the drum, two adaptors protrude through holes in the lid. One is for external connection of the air cylinder to drive the piston of the pump. The other is the pumped liquid color outlet connection.

An air cylinder, to actuate the piston, is preferably connected to a fitting, and then is preferably disconnected when the drum is empty, for connection to the next drum. The air cylinder part of the pump system is preferably not discarded, but is moved from drum to drum.

The driving air cylinder preferably has two sensors associated with it. One sensor detects when the cylinder rod is at full stroke, the other sensor detects when the cylinder rod is fully retracted. In response to the sensors, a controller opens and closes a solenoid valve for a series of very short pulses, delivering air to the cylinder, thereby moving the cylinder rod down incrementally against the piston, against the bias of a spring, at a slow controlled rate calibrated to deliver the liquid color at a rate that matches the extrusion or consumption rate of the plastic molding or extrusion process. When the bottom of the stroke is detected, the air is released, and the cylinder rod and the pump piston, biased by the spring, retract. When the pump piston and cylinder rod are fully retracted, the second switch detects this, and the cycle of small air pulses may then begin again.

Each pulse moves the air cylinder rod and pump piston a pre-determined amount. The volume displaced in a full stroke is known. In this design the volume preferably is 5 cubic centimeters. The number of pulses required to complete a full 5 cubic centimeter displacement can be determined through calibration, by counting pulses from the top extreme to the bottom extreme of the stroke. Using this information the volume displaced per pulse may be calculated. Typically ten or twenty pulses are required to move the piston through the length of its full stroke.

The interior of a PVC pipe "T" forms an excellent chamber for the pumping action. In one embodiment the piston operates within a very short length of pipe (desirably about two and three-quarter inches) installed in the leg part of the "T". The left and right arms of the "T" are the liquid color inlet and liquid color outlet ports. Fitted in each one of these ports is a urethane disk-washer check valve.

In another, preferred embodiment, the piston operates within a short length of PVC pipe forming an extension of one of the arms of the "T"; with the remaining arm of the "T" serving as the liquid color inlet and with the leg of the "T" serving as the outlet.

The pump piston desirably includes a dual O-ring design. One O-ring seals in order to pump, and a second O-ring prevents any bypassed liquid color from exiting out of the top. A weep hole in the pipe wall, located between the O-rings, provides a drain point if liquid color seeps past the first O-ring.

The check valves include urethane disks, preferably sized to exactly fit the "T" inlet and outlet openings. The disks have a preferably concentric, generally centered, preferably circular portion that is partially separated from the outer portion or ring of the disk around an arc of less than three hundred sixty degrees, so that the inner preferably circular portion works as a flap relative to the outer ring portion of the disk. When layered against a steel washer of the same size, namely a rigid metal disk with a hole in it, with the hole being smaller than the opening in the urethane disk created when the flap is in the open position, the flap seals the washer hole when liquid flow is a the direction that the liquid presses the flexible flap of the urethane disk against the washer, but opens easily when the liquid flow is from the other direction and pushes the flexible flap of the urethane disk away from the washer.

This combination of flap-equipped disk and washer form a very simple, low cost, and effective check valve. By using one such check valve on the inlet side that allows liquid color flow into the piston area, and another such check valve on the outlet side, that only allows liquid color flow out of the piston area, liquid color is assured to flow in only one, desired direction as the piston pulses. A spring pushes the piston up, causing liquid color to flow into the piston area, namely the chamber-like interior of the "T". The air cylinder pushes the piston down, causing liquid color to flow out of the piston area, namely out of the chamber-like interior of the "T".

The check valve disks desirably are held in place by PVC reducing bushings, which also reduce the size of the "T" by one pipe size. In the preferred embodiment, the "T" is three-quarter inch I.D. pipe, and the reducing bushings reduce this to one-half inch I.D. pipe. One-half inch pipe is used to carry the liquid color to the pump as well as away from it.

The pump controller desirably has a keypad and display that allows for the input of certain information so that the liquid color dispense rate can be calculated. The information is (i) weight of the part being molded, (ii) the percentage of color, by weight, required for the part being molded, and (iii) the bulk density of the liquid color, expressed in pounds per gallon, which allows the controller to translate the weight in grams into the volume in cubic centimeters.

In addition, when the pump is used with an injection molding machine, molding machine screw recovery time is monitored, through a separate electrical signal input. The color required for each cycle is supplied during this recovery time.

From this data and from the calibration routine that has determine the volume metered per pulse, the controller calculates how many piston pulses to deliver for each machine cycle, as well as how slowly or rapidly to deliver these pulses, to achieve the desired liquid color output flow in the time required.

To control the air cylinder a solenoid is pulsed using very short electrical pulses, which are controlled by an associated computer. Each pulse may be as little as three milliseconds in length. Using these pulses, force application and hence piston movement is not constant as the piston travels the length of its stroke. The timing and frequency of these pulses may be varied according to the desired liquid color output in a given time, as described above, effectively providing a variable speed pump, allowing precise control over the volume of liquid delivered while using a low cost, air driven, pump.

At the end of each cycle, the piston position is maintained. The next cycle begins at that point and moves the piston further for the next delivery of liquid color to the injection molding or other process machine.

When the air cylinder rod and pump piston reach the full stroke indicator, they return to the home position and start over, picking up the pulse count where it left off.

Referring now to the drawings in general and to FIG. 1 in particular, a preferred embodiment of a liquid color pump in accordance with the invention is designated generally 10, while a liquid color container in which pump 10 partially resides has been shown partially broken away and is designated generally 12.

Pump 10 includes an air cylinder 14 mounted at the upper extremity of a series of components forming a downwardly extending conduit as illustrated in FIG. 1, where the conduit defined by the various components is shown in the exploded view and has not been numbered. Two reed switches 74 are associated with air cylinder 14. One reed switch admits pressurized air to the air cylinder, thereby causing the cylinder rod of the air cylinder to move downwardly as viewed in FIG. 1. The second reed switch releases pressurized air from the air cylinder thereby permitting the air cylinder rod to move upwardly in the configuration illustrated in FIG. 1.

Air cylinder 14 is mounted on an air cylinder mounting plate 70 by a plurality of button head cap screws 72, only one of which has been numbered in FIG. 1. Positioned immediately below air cylinder mounting plate 72 is a jam nut 68 that, in cooperation with air cylinder mount 42 immediately below jam nut 68, facilitates selective attachment and detachment of air cylinder 14 to and from a first PVC hose adaptor 48. The end of PVC hose adapter 48 protruding upwardly through an opening in the wall of liquid color container 12 is threaded for residence within a cylindrical bore in air cylinder mount 42 and threaded engagement with jam nut 68. This arrangement facilitates connection and removal, as desired, of air cylinder 14 to and from the remainder of pump 10. As illustrated in FIG. 1, first PVC hose adapter 48 is mounted in an aperture in the wall of liquid color container 12.

Still referring to FIG. 1, immediately below first PVC hose adapter 48, is a piston O-ring 78, serving to provide a seal. Piston 16 is below O-ring 78 and is reciprocable vertically in response to contact by the actuator rod of air cylinder 14 and bias of a spring 18 located immediately below piston 16. A second O-ring 78 is provided to assure a seal between piston 16 and the inner wall of the tubular PVC extension 22 that houses spring 18 and within which piston 16 moves reciprocally. Preferably connected to tubular PVC extension 22 are a pair of magnetic sensors 88 positioned at the vertical extremities of travel of piston 16. Sensors 88 sense when piston is at its upper extremity of travel and at its lower extremity of travel, thereby providing signals to a control used to regulate the operation of air cylinder 14 and hence of piston 16 within tubular PVC extension 22. Sensors 88 may alternately be mounted on air cylinder 14.

Coil spring 18 biases piston 16 upwardly continuously. When air cylinder 14 is actuated, the downward force provided by the compressed air within air cylinder 14 is sufficient that the force of the actuator rod of air cylinder 14 contacting the upper surface of piston 16 is sufficient to overcome the bias applied to piston 16 by coil spring 18 and thereby drive piston 16 downwardly against the bias of coil spring 18 until the lower one of magnetic sensors 88 illustrated in FIG. 1 senses presence of the piston. This provides a signal to a controller for actuation of the reed switch that permits compressed air to escape from air cylinder 14 thereby stopping downward movement of piston 16.

Tubular PVC extension 22 on which magnetic sensors 88 are preferably mounted and which houses piston 16 and coil spring 18 connects to "T"-shaped PVC tubular member 20 at one leg of the "T". As piston 16 reciprocates vertically in response to the action of air cylinder 14, piston 16 contacts liquid color within "T"-shaped PVC tubular member 20 and any liquid color within tubular PVC extension 22, thereby tending to compress liquid color contained therewithin and raise the pressure of that liquid color, thereby forcing the liquid color, in a pumping action, out of "T"-shaped PVC tubular member 20 through the leg portion of the "T".

Liquid color leaving the interior of "T" 20, which interior is sometimes referred to herein as being a "chamber", passes through an outlet pipe O-ring 60 that is connected to "T" 20, specifically at the leg thereof, as illustrated in FIG. 1. Connected to the leg or outlet portion of "T" 20 is an outlet PVC pipe bushing 58, within which is located outlet check valve 26 including disk 32 of outlet check valve 26 and washer 34 of outlet check valve 26.

Outlet PVC pipe horizontal extension 56 connects in turn to outlet PVC pipe elbow 54, as illustrated in FIG. 1, which turns the output of liquid color into a vertical direction for passage through outlet PVC pipe vertical extension 52 and then on to second PVC hose adaptor 50, which is mounted in wall of liquid color container 12 and provides a desirably threaded connection for a hose or other tubular member to convey the pumped liquid color to an injection molding machine or a gravimetric blender or other piece of plastic resin processing equipment, where the liquid color will be mixed with plastic resin for further processing into a finished product.

The inlet to "T"-shaped PVC tubular member 20 is provided by a remaining one of the arms of the "T"-shaped PVC tubular member 20 which, like the first-mentioned arm and the leg of the "T", have not been numbered to enhance drawing clarity. Upstream of the inlet to "T" 20 is a spring retainer 64 and immediately upstream of that resides inlet check valve designated generally 24, which includes a disk 28 and a washer 30. Further upstream of inlet check valve 24 is an inlet pipe O-ring 66, with the O-ring and the inlet check valve being retained in place by a PVC pipe bushing 46 which facilitates connection of liquid color PVC intake lance 44. Hence, liquid color is drawn into the interior chamber of "T"-shaped tubular member 20 by entering the liquid color PVC intake lance 44 via pump liquid color inlet 86.

Figure 3:
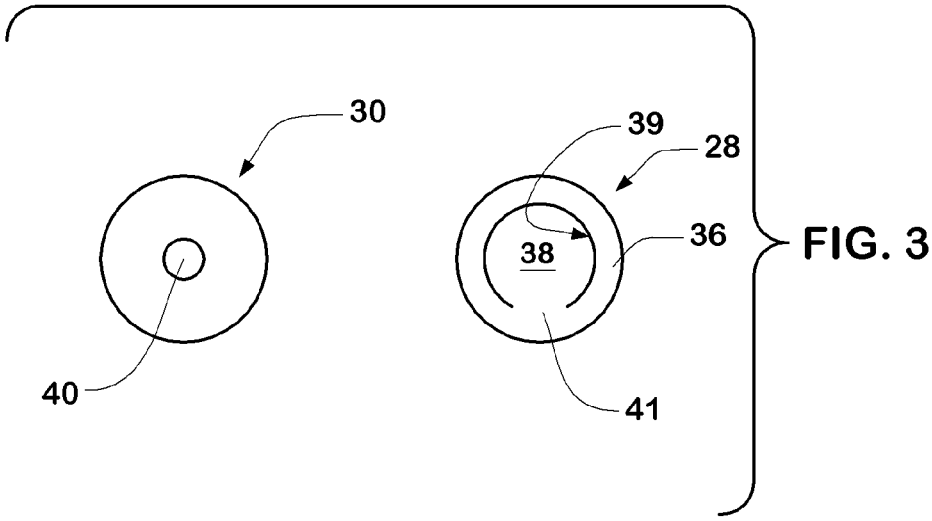
FIG. 3 is a frontal view of the disk and the washer components of a check valve in accordance with aspects of the invention.
Figure 4:
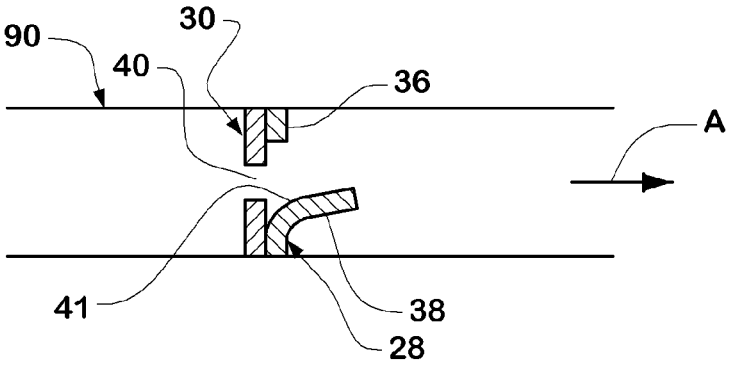
FIG. 4 is a broken schematic elevation, in section, illustrating a check valve in accordance with the invention, with the check valve permitting fluid flow therethrough.
Figure 5:
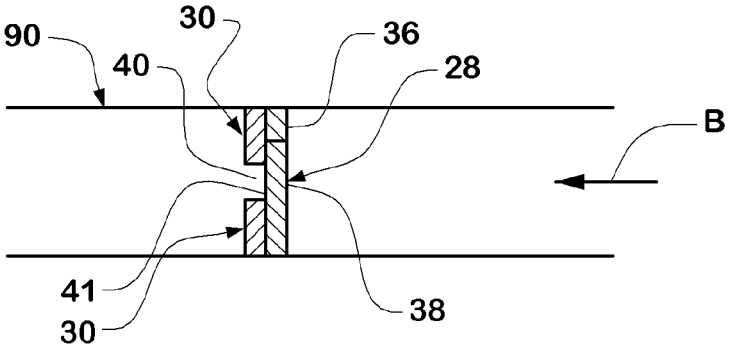
FIG. 5 is a broken schematic elevation, in section, illustrating a check valve in accordance with the invention, with the check valve precluding fluid flow therethrough.

Referring to FIGS. 3, 4 and 5, both the inlet and outlet check valves are of the same construction, with the components of inlet check valve 24 being illustrated in FIGS. 3, 4 and 5.

Referring to FIG. 3, washer 30 of inlet check valve 24 includes an aperture 40 located at the center of washer 30. Inlet check valve 24 further includes disk 28, which is preferably a piece of uniform, solid urethane in the shape of a circular disk as shown, with a cut 39 extending completely through disk 28 and being in the form of an arc such that cut 39 does not extend entirely around disk 38, but rather leaves an uncut portion 41. This configuration results in the central portion 38 of disk 28 acting as a flap portion hinging about uncut portion 41. Check valve 26 is of identical construction.

Referring to FIGS. 4 and 5, disk 28 is preferably installed within any PVC conduit which has been designated generally 90 solely for purposes of explanation of the check valve construction and operation, in a manner to be flush with washer 40 and to permit flow in the direction indicated by arrow A in FIG. 4. When liquid color is flowing in the direction indicated by arrow A in FIG. 4, flap 38 hinges about uncut portion 41 into the position illustrated in FIG. 4, thereby permitting flow of liquid color in the direction indicated by arrow A through aperture 40 and washer 30 and then through the interior space of disk 28, within annular portion 36 of disk 28, which interior portion has been vacated due to the hinging action of flap portion 38 about uncut portion 41, all as illustrated in FIG. 4.

When there is any liquid color flow in the opposite direction, as indicated by arrow B in FIG. 5, flap portion 38 hinges about uncut portion 41 and retreats into the position illustrated in FIG. 5 where flap portion 38 fits within the annular ring portion 36 of disk 28, as flap portion 38 contacts the portion of washer 30 that defines the peripheral structure around aperture 40 therein. As a result, disk 28 with flap portion 38 fitting flushly against washer 30 and with flap portion 38 being of a size significantly larger than diameter of aperture 40 in washer 30, disk 28 forms a liquid tight seal against any liquid color flow in the direction indicated by arrow B in FIG. 5.

Figure 2:
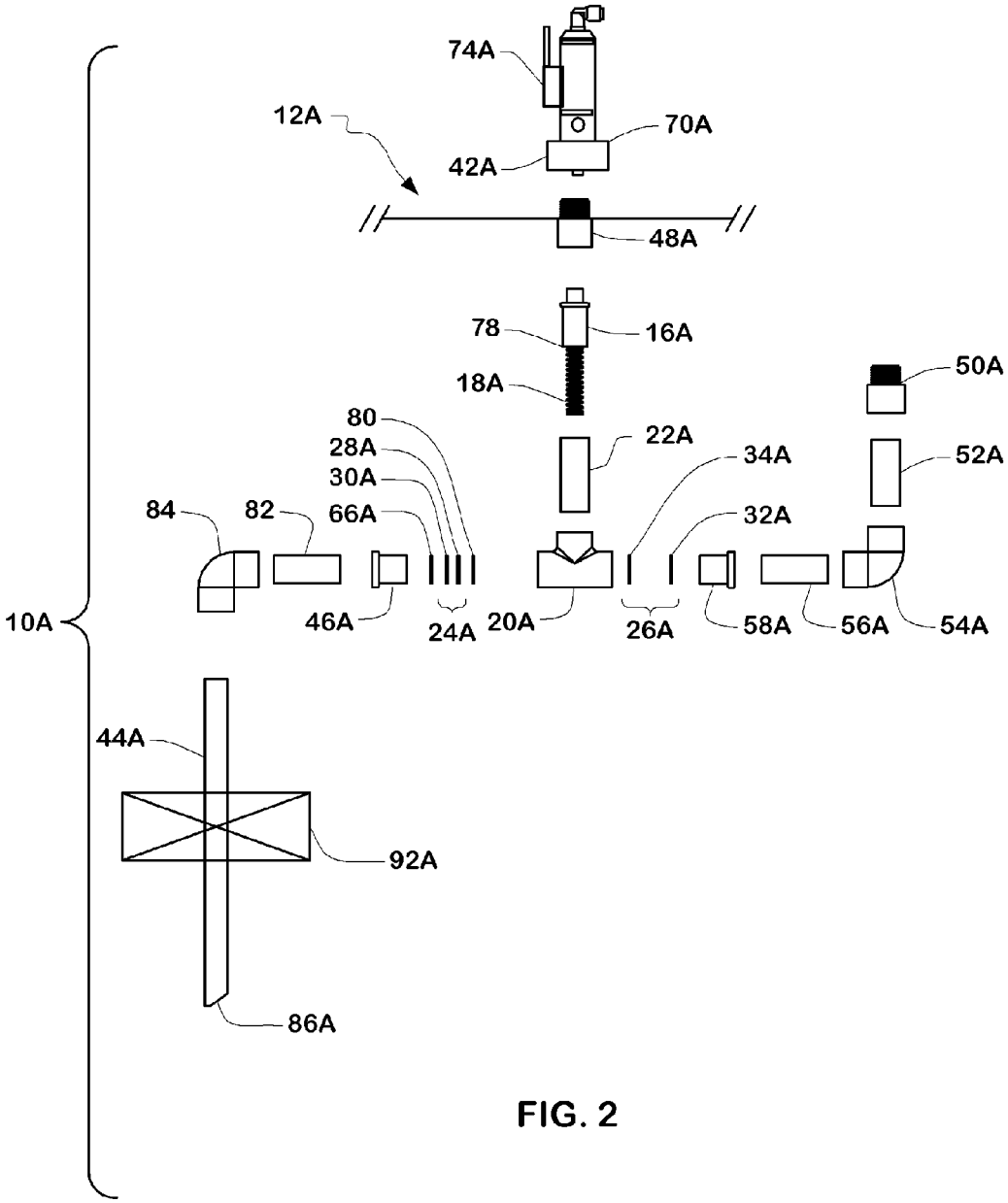
FIG. 2 is an exploded view, in elevation, similar to FIG. 1, showing an alternate embodiment of a liquid color pump and liquid color container in accordance with aspects of the invention.

Referring to FIG. 2, as noted above, the parts of the alternate embodiment of the pump illustrated in FIG. 2, which are functionally equivalent or substantially the same as corresponding parts in FIG. 1, have the same numbers. Use of the letter "A" in FIG. 2 identifies and distinguishes those parts from functionally corresponding and/or substantially similar parts in FIG. 1.

As clear from FIG. 2, configuration of pump 10A is such that the pumping action of reciprocating piston 16A within tubular PVC extension 22A effectuates pumping pressure within the interior chamber of "T"-shaped PVC tubular member 20A through the leg of the "T". Liquid color input to the chamber within "T"-shaped PVC tubular member 20A is via one arm of the "T" while liquid color output is via the other arm of the "T". With respect to FIG. 2, the PVC piping downstream of outlet check valve 26A may be configured in any suitable manner so that second PVC hose adaptor 50 fits within a desired portion of the wall of container 12A, providing either vertical or horizontal output of liquid color pumped by pump 10A.

Referring to both FIG. 1 and FIG. 2, an alternate liquid color inlet fixture is depicted schematically as 92 and 92A in the two Figures. It is to be understood that the pump 10 or 10A may be positioned outside of container 12 or 12A with a suitable fixture being provided such as indicated schematically by 92 so that the pump may be used in container after container after container, as each container is successively emptied. In such case, the pump is reused many times as it empties many containers. In the preferred configurations illustrated in FIGS. 1 and 2, the air cylinder 14 or 14A is removed from the container 12 or 12A once the pump has emptied the container of liquid color. Thereafter, the container 12 or 12A, with the parts of pump 10 or 10A that reside within container 12 or 12A remaining therein, is customarily discarded.

In the preferred practice of the invention, as set forth above, off-the-shelf parts are used. Specifically, the various conduits, elbows and the "T" member are all PVC pipe and fittings, which are commercially available and are very inexpensive. Similarly, the bushings, springs, washers, urethane disks, coil springs, PVC hose adaptors and the like are all readily available components that may be purchased at Home Depot, Lowes or similar outlets. As a result, the pump in accordance with the invention, and the combination of the pump and the container of liquid color in accordance with the invention, may be fabricated at very low material cost, thereby providing a product that is highly price competitive.

The invention claimed is:

1. A pump for liquid color comprising:

a) a one piece PVC plastic fitting of integral construction having an inlet, an outlet and a pumping chamber positioned between the inlet and outlet;

b) a piston moveable into the chamber via a third chamber aperture that is in addition to the inlet and the outlet, to displace liquid color from the chamber and out of the fitting via the outlet;

c) a cylinder for driving the piston into the chamber;

d) a spring for biasing the piston outwardly of the chamber, in opposition to force applied by the cylinder, the spring being positioned at the third chamber aperture;

e) a check valve at the conduit inlet, permitting fluid flow into the chamber, but precluding fluid flow out of the chamber responsively to piston displacement into the chamber; and f) a check valve at the conduit outlet permitting fluid flow out of the chamber responsively to fluid pressure increase resulting from piston displacement into the chamber.

2. The liquid color pump of claim 1 wherein the check valve at the conduit inlet comprises:

a) a first polymeric disk having a central portion partially separated from an outer ring portion of the first disk, such that the central portion acts as a flap relative to the outer ring portion; and b) a first washer facingly contacting and located upstream of the first disk relative to the chamber, having an open center of smaller size than the central portion of the first disk, whereby upon fluid flow out of the chamber through the conduit inlet, the central portion of the first disk contacts the first washer and blocks the open center thereof, precluding further fluid flow out of the chamber through the conduit inlet;

and wherein the check valve at the conduit outlet comprises:

c) a second polymeric disk fitting within the conduit outlet from the pumping chamber and having a central portion partially separated from an outer ring portion of the disk, such that the central portion acts as a flap relative to the outer ring portion; and d) a second washer facingly contacting the disk and located upstream of the second disk within the conduit outlet from the pumping chamber, having an open center of smaller size than the central portion of the disk, the central portion of the disk contacting the washer and blocking the open center thereof, precluding fluid flow into the pumping chamber but fluid flowing out of the pumping chamber through the conduit outlet flows through the open center of the second washer, displacing the central portion of the second disk in the fashion of a flap.

3. Apparatus for shipping, storing and dispensing liquid color, comprising:

a) a container for receiving and storing liquid color;

b) a pump for dispensing liquid color from the container, comprising:

i) a one piece T-shaped plastic pipe fitting, an open interior of the fitting defining a chamber, the "T"-shaped fitting having two arms and a leg joined together, extremities of the arms and the leg remote from where the arms and the leg come together defining three extremities of the "T", one extremity of the "T" defining an outlet from the chamber, a second extremity of the "T" defining an inlet to the chamber;

ii) a piston displaceable along a third extremity of the "T" towards the chamber;

iii) a cylinder for driving the piston along the third extremity of the "T", towards the chamber;

iv) a spring for biasing the piston outwardly from the chamber, in opposition to force applied by the cylinder;

v) a check valve upstream of the inlet to the chamber, for permitting fluid flow into the chamber but precluding fluid flow out of the chamber through the inlet responsively to piston displacement into the chamber; and vi) a check valve in the extremity of the "T" defining the outlet from the chamber, for permitting fluid flow out of the chamber through the inlet responsively to fluid pressure increase resulting from piston displacement into the chamber;

c) the spring, the piston, the "T"-shaped plastic pipe fitting, and the check valves being within the container; and d) the cylinder being outside of the container and removably connected thereto.

4. Apparatus of claim 3 wherein the pump further comprises:

a) a pair of magnetic pick-ups mounted on a conduit defining at least a part of the third extremity of the "T", for sensing when the piston is at respective extremes of piston travel and providing signals for respectively actuating and de-actuating the cylinder.

5. Apparatus of claim 3 wherein each check valve comprises:

a) a polymeric disk having a center portion partially separated from an outer portion of the disk, the center portion acting as a flap relative to the outer portion;

b) a washer contacting the disk and located upstream thereof relative to a desired direction of fluid flow, having an opening smaller than but aligned with the center portion of the disk, whereby upon fluid flow in a first direction the center portion of the disk contacts the washer and blocks the open center thereof, precluding further fluid flow in the first direction but fluid flowing in the desired second direction flows through the open center of the washer and displaces the center portion of the disk for continued fluid flow through the center portion of the disk in the desired second direction.

6. Apparatus of claim 5 wherein the disks are urethane.

7. The pump of claim 1 wherein each check valve comprises:

a) a polymeric disk having a central portion partially separated from an outer portion of the disk, such that the central portion acts as a flap relative to the outer portion; and b) a rigid washer contacting the disk and located upstream thereof relative to a desired direction of fluid flow, having an opening smaller than but aligned with the central portion of the disk, whereby upon fluid flow in a first direction through the conduit in which the check valve resides the central portion of the disk contacts the washer and blocks the open center thereof, precluding further fluid flow in the first direction, but fluid flowing in the desired second direction, through the conduit in which the check valve resides, flows through the open center of the washer and displaces the central portion of the disk for continued fluid flow through the central portion of the disk in the desired second direction.

8. The pump of claim 7 wherein the disks are urethane.

9. The apparatus of claim 3 wherein the "T"-shaped pipe fitting is PVC.

10. Apparatus for shipping, storing and dispensing liquid color, comprising:

a) a container for receiving, shipping and storing liquid color;

b) a pump connected to the container for dispensing liquid color from the container, comprising:

i) a one-piece "T"-shaped PVC fitting having openings at the extremity of the leg of the "T" and at the extremities of the arms of the "T", one of said openings defining an inlet to the fitting, another of the openings defining an outlet from the fitting and a chamber positioned between the inlet and outlet, the openings to the fitting totaling three (3) in number;

ii) a piston displaceable into the chamber via the third opening;

iii) an air cylinder for driving the piston into the chamber;

iv) a coil spring for biasing the piston coaxially outwardly from the chamber, in opposition to force applied by the air cylinder, the spring being positioned at the opening to the fitting via which the piston is displaceable into the chamber;

v) a check valve at the conduit inlet, for permitting liquid color flow from within the container into the chamber but precluding fluid flow out of the chamber responsively to piston displacement into the chamber; and vi) a check valve at the conduit outlet, for permitting liquid color fluid flow out of the chamber responsively to fluid pressure increase resulting from piston displacement into the chamber;

c) the spring, the piston, the "T"-shaped PVC fitting conduit and the check valves being within the container; and d) the air cylinder being outside of the container and removably connected thereto.

11. A pump for liquid color comprising:

a) a one-piece T-shaped PVC pipe fitting, an open interior of the fitting defining a pumping chamber, one arm of the top of the "T"-shaped PVC fitting defining an outlet from the chamber and a remaining arm of the top of the "T"-shaped PVC fitting defining an inlet to the chamber;

b) a PVC extension conduit extending from the leg of the "T"-shaped PVC fitting away from the chamber;

c) a piston displaceable through at least a portion of the PVC extension conduit towards the chamber;

d) an air cylinder for driving the piston towards the chamber;

e) a spring within the PVC extension conduit for biasing the piston outwardly from the chamber;

f) a check valve in the arm defining an inlet to the chamber, for permitting fluid flow into the chamber but precluding fluid flow out of the chamber responsively to piston displacement into the chamber; and g) a check valve at the arm defining an outlet from the chamber, for permitting fluid flow out of the chamber responsively to fluid pressure increase resulting from piston displacement into the chamber.

12. The pump of claim 11 wherein the check valves each comprise:

a) a polymeric disk having a central portion partially separated from an outer ring portion, such that the central portion acts as a flap relative to the outer ring portion; and b) a washer facingly contacting and located upstream of the disk relative to the chamber, having an open center of smaller size than the central portion of the disk, wherein the polymeric disk and washer are in facing contact.

13. The pump of claim 12 wherein the disk is urethane.

14. The pump of claim 1 wherein the PVC pipe fitting is "T"-shaped.

15. A pump for liquid color used to color plastic resin in the course of molding or extrusion, comprising:

a) A "T"-shaped one-piece plastic housing having an interior chamber with an inlet for liquid color flow into the chamber, an outlet for pumped liquid color flow out of the chamber, and a passageway communicating with the chamber, the inlet, the outlet and the passageway being at respective extremities of the arms and the leg of the "T"-shaped housing;

b) a pumping piston residing in the passageway and being displaceable towards the chamber;

c) a piston-cylinder combination for urging the pumping piston toward the chamber;

d) a spring residing in the passageway for biasing the pumping piston away from the chamber;

e) an inlet check valve permitting fluid flow into the chamber but precluding fluid flow out of the chamber; and f) an outlet check valve permitting fluid flow out of the chamber but precluding fluid flow into the chamber.

16. The pump of claim 15 wherein the housing is polyvinyl chloride.

17. The pump of claim 15 wherein the passageway is in the leg of the "T".

18. The pump of claim 15 wherein the passageway is in one arm of the "T".

19. The pump of claim 15 wherein the check valves are urethane disks.

20. Apparatus for shipping, storing, and dispensing liquid color used to color plastic resin in the course of molding or extrusion, comprising:

a) a container for receiving and storing liquid color;

b) a pump connected to the container and comprising:

i) a "T"-shaped one-piece plastic housing having an interior chamber with an inlet for liquid color flow into the chamber from the container, an outlet for pumped liquid color flow out of the chamber, and a passageway communicating with the chamber, the inlet, the outlet and the passageway being at respective extremities of the arms and the leg of the "T"-shaped plastic housing;

ii) a pumping piston residing in the passageway and being displaceable towards the chamber;

iii) a piston-cylinder combination for urging the pumping piston toward the chamber;

iv) a spring for biasing the pumping piston away from the chamber;

v) an inlet check valve permitting fluid flow into the chamber but precluding fluid flow out of the chamber; and vi) an outlet check valve, permitting fluid flow out of the chamber but precluding fluid flow into the chamber;

c) the pumping piston and the housing being within the container;

d) the piston-cylinder combination being outside the container;

e) the passageway extending from the chamber to the piston-cylinder combination.

21. Apparatus of claim 20 wherein the housing is polyvinyl chloride.

22. Apparatus of claim 20 wherein the passageway is the leg of the "T".

23. Apparatus of claim 20 wherein the passageway is in one arm of the "T".

24. Apparatus of claim 20 wherein the check valves are urethane disks.

25. Apparatus for shipping, storing and dispensing liquid color, comprising:

a) a container for receiving and storing liquid color;

b) a pump connected to the container for dispensing liquid color therefrom, comprising:

i) a one piece T-shaped plastic pipe fitting, an open interior of the fitting defining a chamber, the "T"-shaped fitting having two arms and a leg joined together, extremities of the arms and the leg remote from where the arms and the leg come together defining three extremities of the "T", one extremity of the "T" defining an outlet from the chamber, a second extremity of the "T" defining an inlet to the chamber;

ii) a piston displaceable along a third extremity of the "T" towards the chamber;

iii) a cylinder for driving the piston along the third extremity of the "T", towards the chamber;

iv) a spring for biasing the piston outwardly from the chamber, in opposition to force applied by the cylinder, the spring being positioned so that liquid color flow from the chamber inlet to the chamber outlet does not pass around the spring;

v) a check valve upstream of the inlet to the chamber, for permitting fluid flow into the chamber but precluding fluid flow out of the chamber through the inlet responsively to piston displacement into the chamber; and vi) a check valve in the extremity of the "T" defining the outlet from the chamber, for permitting fluid flow out of the chamber through the inlet responsively to fluid pressure increase resulting from piston displacement into the chamber;

c) each check valve comprising:

i) a urethane disk having a center portion partially separated from an outer portion of the disk, the center portion acting as a flap relative to the outer portion;

ii) a washer contacting the disk and located upstream thereof relative to a desired direction of fluid flow, having an opening smaller than but aligned with the center portion of the disk, whereby upon fluid flow in a first direction the center portion of the disk contacts the washer and blocks the open center thereof, precluding further fluid flow in the first direction but fluid flowing in the desired second direction flows through the open center of the washer and displaces the center portion of the disk for continued fluid flow through the center portion of the disk in the desired second direction;

d) a pair of magnetic pick-ups, mounted on a conduit defining at least a part of the third extremity of the "T", for sensing when the piston is at respective extremes of travel and providing signals for respectively actuating and de-actuating the cylinder;

e) the spring, the piston, the "T"-shaped plastic pipe fitting, and the check valves being within the container; and f) the cylinder being outside of the container and removably connected thereto.

26. A pump for liquid color consisting of:

a) a one piece T-shaped plastic pipe fitting, an open interior of the fitting defining a chamber, the "T"-shaped fitting having two arms and a leg joined together, extremities of the arms and the leg remote from where the arms and the leg come together defining three extremities of the "T", one extremity of the "T" defining an outlet from the chamber, a second extremity of the "T" defining an inlet to the chamber;

b) a piston displaceable along a third extremity of the "T" towards the chamber;

c) a cylinder for driving the piston, along the third extremity of the "T", towards the chamber;

d) a spring for biasing the piston outwardly from the chamber, in opposition to force applied by the cylinder;

e) a check valve upstream of the inlet to the chamber, for permitting fluid flow into the chamber but precluding fluid flow out of the chamber through the inlet responsively to piston displacement into the chamber consisting of;

i) a polymeric disk having a center portion partially separated from an outer portion of the disk, the center portion acting as a flap relative to the outer portion; and ii) a washer contacting the disk and located upstream thereof relative to a desired direction of fluid flow, having an opening smaller than but aligned with the center portion of the disk, whereby upon fluid flow in a first direction the center portion of the disk contacts the washer and blocks the open center thereof, precluding further fluid flow in the first direction but fluid flowing in the desired second direction flows through the open center of the washer and displaces the center portion of the disk for continued fluid flow through the center portion of the disk in the desired second direction;

f) a check valve in the extremity of the "T" defining the outlet from the chamber, for permitting fluid flow out of the chamber through the inlet responsively to fluid pressure increase resulting from piston displacement into the chamber consisting of i) a polymeric disk having a center portion partially separated from an outer portion of the disk, the center portion acting as a flap relative to the outer portion; and ii) a washer contacting the disk and located upstream thereof relative to a desired direction of fluid flow, having an opening smaller than but aligned with the center portion of the disk, whereby upon fluid flow in a first direction the center portion of the disk contacts the washer and blocks the open center thereof, precluding further fluid flow in the first direction but fluid flowing in the desired second direction flows through the open center of the washer and displaces the center portion of the disk for continued fluid flow through the center portion of the disk in the desired second direction;

g) a pair of magnetic pick-ups, mounted on a conduit defining at least a part of the third extremity of the "T", for sensing when the piston is at respective extremes of travel and providing signals for respectively actuating and de-actuating the cylinder.

27. In a pump for liquid color having a pump housing with an inlet, an outlet, a pumping chamber and a piston movable therein for pumping liquid color, the improvement comprising:

a) the housing consisting of a one piece PVC plastic fitting of integral construction having the inlet and the outlet formed therein with the pumping chamber defined by the interior of the one-piece PVC fitting positioned between the inlet and outlet;

b) the piston being displaceable into the chamber via a third aperture formed in the housing in addition to the inlet and the outlet, to displace liquid color from the chamber out of the housing via the outlet;

c) a cylinder exterior of the housing and connected thereto, for driving the piston into the chamber;

d) a spring for biasing the piston outwardly of the chamber, in opposition to force applied by the cylinder, the spring being positioned at the third aperture;

e) a check valve at the inlet, permitting fluid flow into the chamber, but precluding fluid flow out of the chamber upon piston displacement into the chamber;

f) a check valve at the outlet permitting fluid flow out of the chamber responsively to pressure resulting from piston displacement into liquid color in the chamber.

28. The liquid color pump of claim 27 wherein the improvement further comprises:

a) the check valves having polymeric disks with central portions partially separated from outer ring portions of the disk, the central portions acting as flaps relative to the outer ring portions; and b) washers facingly contacting and located upstream of the disk relative to direction of flow at the respective inlet or outlet, having open centers of smaller size than the central portion of the disks;

whereby upon fluid flow through the inlet or outlet, the central portion of the disk contacts the washer and blocks the open center thereof, precluding further fluid flow in the direction contra to the respective inlet or outlet.

29. In apparatus having a container for storing and receiving liquid color and a pump for dispensing liquid color from the container, the pump having an inlet, an outlet, a pumping chamber and a piston for pumping the liquid color, the improved combination in which the pump consists of:

a) a housing defined by a one piece T-shaped plastic pipe fitting, an open interior of the fitting defining a chamber, the "T"-shaped fitting having two arms and a leg joined together, extremities of the arms and the leg remote from where the arms and the leg come together defining three extremities of the "T", one extremity of the "T" defining an outlet from the chamber, a second extremity of the "T" defining an inlet to the chamber;

b) a piston displaceable along a third extremity of the "T" towards the chamber;

c) a cylinder for driving the piston along the third extremity of the "T", towards the chamber;

d) a spring for biasing the piston outwardly from the chamber, in opposition to force applied to the piston by the cylinder;

e) check valves connected to the housing at the inlet and the outlet, for permitting fluid flow into and out of the chamber via the inlet and outlet respectively responsively to piston displacement into liquid color residing in the chamber.

30. The improved combination of claim 29 with the spring, the piston, the "T"-shaped plastic pipe fitting, and the check valves being within the container; and the cylinder being outside of the container and removably connected thereto.

31. The improved combination of claim 29 further comprising magnetic pick-ups mounted on a conduit defining at least a part of the third extremity of the "T", for sensing when the piston is at respective extremes of piston travel and providing signals for respectively actuating and de-actuating the cylinder.

32. The improved combination of claim 29, each check valve consisting of:

a) a polymeric disk having a center portion partially separated from an outer portion of the disk, the center portion acting as a flap relative to the outer portion; and b) a washer contacting the disk and located upstream thereof relative to a desired direction of fluid flow, having an opening smaller than but aligned with the center portion of the disk, whereby upon fluid flow in a first direction the center portion of the disk contacts the washer and blocks the open center thereof, precluding further fluid flow in the first direction but fluid flowing in the desired second direction flows through the open center of the washer and displaces the center portion of the disk for continued fluid flow through the center portion of the disk in the desired second direction.

33. The improved combination of claim 32, the disks being urethane.

* * * * *